US006571426B2

(12) United States Patent
Chen

(10) Patent No.: US 6,571,426 B2
(45) Date of Patent: Jun. 3, 2003

(54) ADJUSTABLE HANGING ROD

(76) Inventor: Yin-Wen Chen, No. 23, Lane 207, Kao-Feng Road, Hsin chu (TW)

( * ) Notice: Subject to any disclaimer, the term of this patent is extended or adjusted under 35 U.S.C. 154(b) by 0 days.

(21) Appl. No.: 09/858,008

(22) Filed: May 14, 2001

(65) Prior Publication Data

US 2002/0166204 A1 Nov. 14, 2002

(51) Int. Cl.[7] ..... A47H 1/08; A47H 1/022; A47H 1/10

(52) U.S. Cl. ..... 16/87 R; 16/87.4 R; 16/95 R; 16/87.8; 211/105.6; 248/323; 248/353; 248/354.3

(58) Field of Search ..... 16/87.4 R, 87 R, 16/95 R, 87.8; 211/105.5, 105.6; 248/317, 320, 323, 351, 353, 354.1, 354.3

(56) References Cited

U.S. PATENT DOCUMENTS 2,649,971 A * 8/1953 Marchand ..... 211/105.6
3,074,740 A * 1/1963 Zastrow ..... 211/105.6
4,037,726 A * 7/1977 Schweers ..... 211/105.5
4,118,087 A * 10/1978 Dorf ..... 211/105.6
5,799,346 A * 9/1998 Tiernan ..... 211/105.6

* cited by examiner

*Primary Examiner*—Robert E. Pezzuto
*Assistant Examiner*—Tara L. Mayo
(74) *Attorney, Agent, or Firm*—Pro-Techtor International Services

(57) ABSTRACT

An adjustable hanging rod comprising a main body and at least one gliding rod with a contact element and an adjusting mechanism. The main body has a central gliding groove. The gliding rod is inserted in the gliding groove. The contact element is attached to a far end of the gliding rod for contacting a wall. The adjusting mechanism is mounted inside the main body and further comprises a gliding block, inserted in the gliding groove, a guiding rod, attached to the gliding block, a spring, put on the guiding rod between the gliding block and the gliding rod, and a fixing screw for fixing the gliding block. The position of the gliding block is adjusted, so that the gliding rod extends outward by a suitable length and suitable pressure of the contact element against the wall is maintained.

7 Claims, 6 Drawing Sheets

ADJUSTABLE HANGING ROD

BACKGROUND OF THE INVENTION

1. Field of the Invention

The present invention relates to an adjustable hanging rod, particularly to an adjustable hanging rod which is quickly removable.

2. Description of Related Art

A conventional quickly foldable light hanging rod is often used in a bathroom for suspending a curtain or in a wardrobe for suspending cloth hangers. As shown in FIG. 5, a conventional light hanging rod has a characteristic feature of being expandable and compressible, with a spring pressing two ends thereof apart, which are then by friction held on two walls. This kind of light hanging rod mainly comprises: a tube 1, which is hollow, having a closed end and an open end; a cap 2, put on the closed end of the tube 1 and made of plastics or a material with a high friction coefficient; a rod 3, fit into the tube 1 through the open end thereof; and a spring 4, inserted in the tube 1 between the closed end thereof and the rod 3 and being compressed when the rod 3 is pushed into the tube 1; and a cap 5, put on a far end of the rod 3.

The spring 4 pushes the caps 2, 5 on the closed end of the tube 1 and on the far end of the rod 3 apart. Thus the caps 2, 5 are held by friction on two walls of suitable distance, fixing the conventional light hanging rod.

This kind of conventional light hanging rod has a simple structure and is easy to use. However, since the tube 1, the rod 3 and the spring 4 are fastened to each other, there is no way to adjust relative positions thereof. With no way of regulating the combined length of the tube 1 and the rod 3, the light hanging rod cannot be used, if the two walls are farther apart than the combined length of the tube 1 and the rod 3. This restricts the range of use of conventional light hanging rods. Furthermore, the tube 1 and the rod 3 have circular cross-sections. However, this shape is easily deformed when hit, with the rod 3 no longer movable within the tube 1.

SUMMARY OF THE INVENTION

It is the main object of the present invention to provide an adjustable hanging rod which is quickly mounted and convenient to use.

Another object of the present invention is to provide an adjustable hanging rod which is adjustable for a wider range of applications.

The present invention can be more fully understood by reference to the following description and accompanying drawings.

DETAILED DESCRIPTION OF THE PREFERRED EMBODIMENTS

Figure 1:
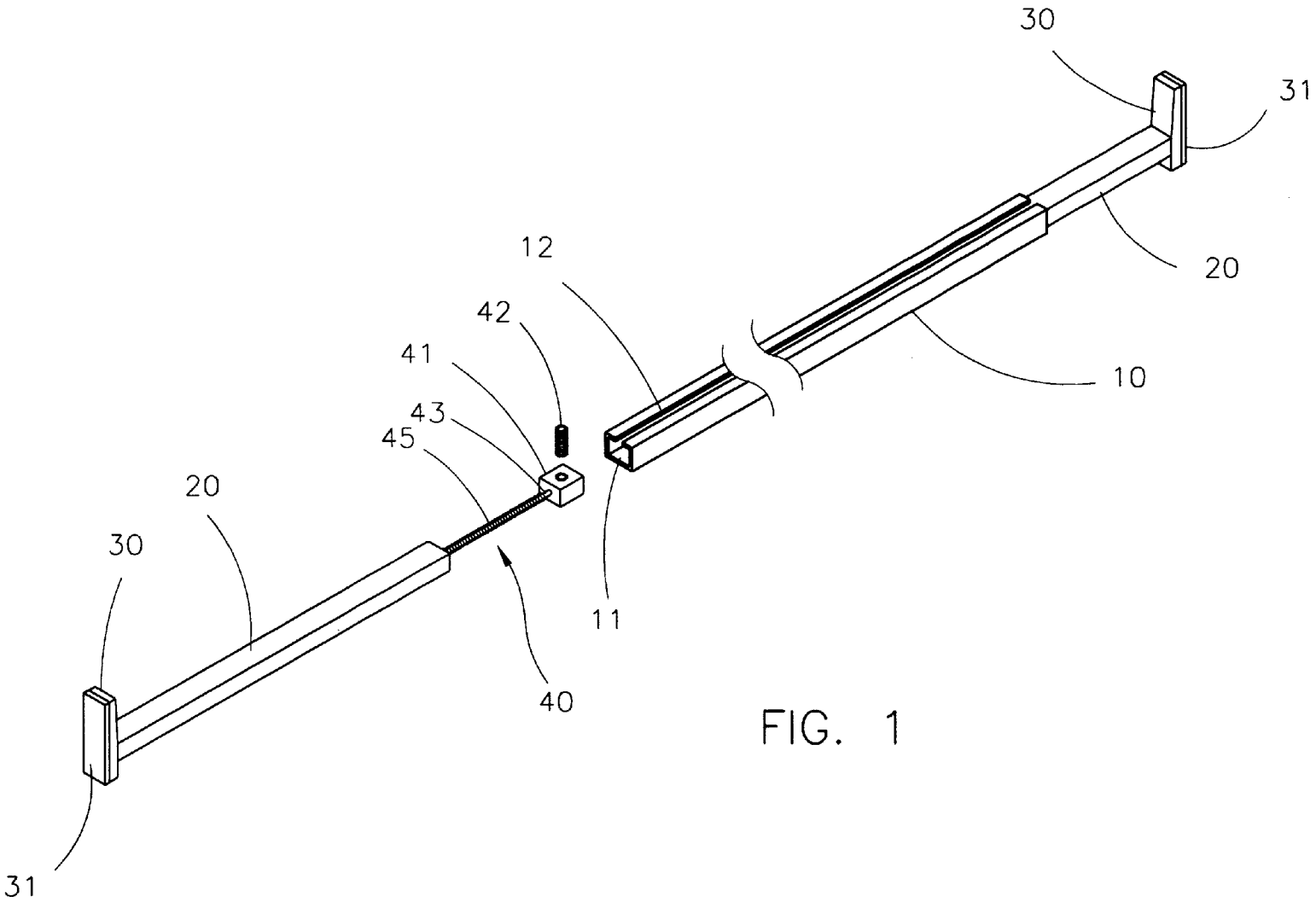
FIG. 1 is a perspective view of the adjustable hanging rod of the present invention.

As shown in FIG. 1, the adjustable hanging rod of the present invention in a first embodiment mainly comprises: a main body 10; at least one gliding rod 20; two contact elements 30; and two adjusting mechanisms 40. The main body 10 is an elongated body having a rectangular cross-section. A central gliding groove 11 runs along the main body 10, having a lower side and an upper side with an elongated opening 12, which makes the gliding groove 11 accessible from above with a tool. The at least one gliding rod 20 is inserted into the gliding groove 11 from one end or two ends thereof, being longitudinally movable therein. Each of the gliding rods 20 has an inserted end and a far end, which carries one of the two contact elements 30. The two contact elements 30 serve to keep contact with two walls 50 which have a mutual distance. Each of the two adjusting mechanisms 40 is mounted on the inserted end of the gliding rod 20, ensuring that the gliding rods 20 extend out of the main body 10 to a degree that suits the distance of the walls 50.

Figure 2:
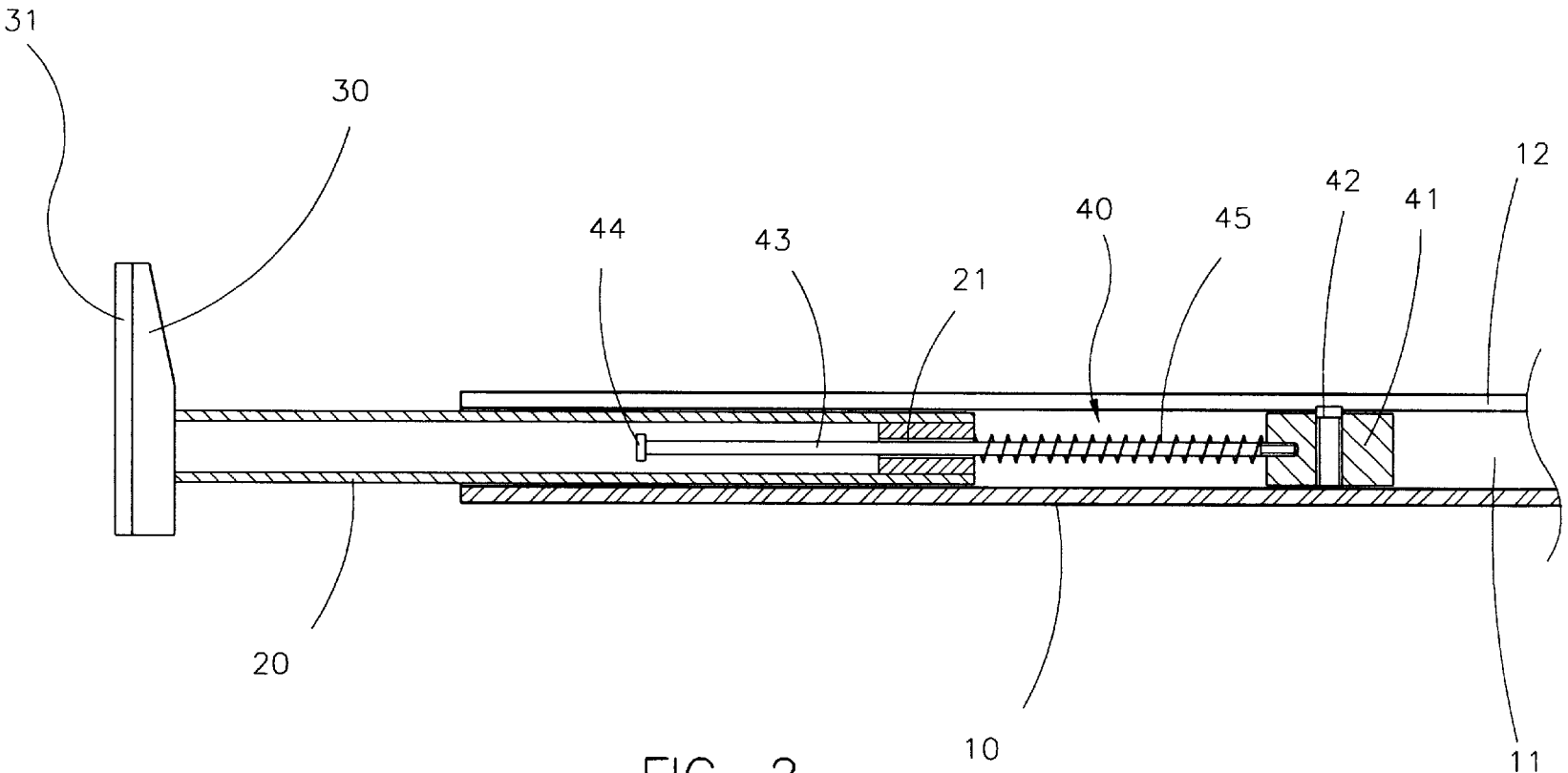
FIG. 2 is a side view of the adjustable hanging rod of the present invention when assembled.
Figure 2B:
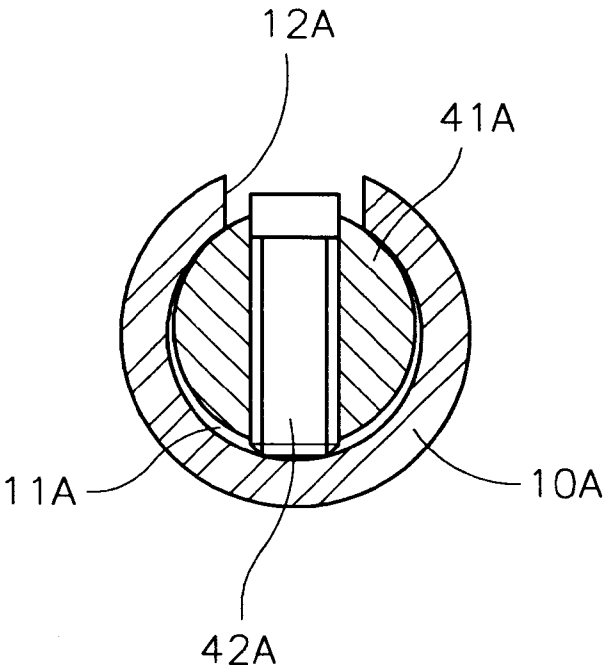
FIG. 2B is a cross-sectional view of the main body and the gliding block of the present invention in the second embodiment.
Figure 2A:
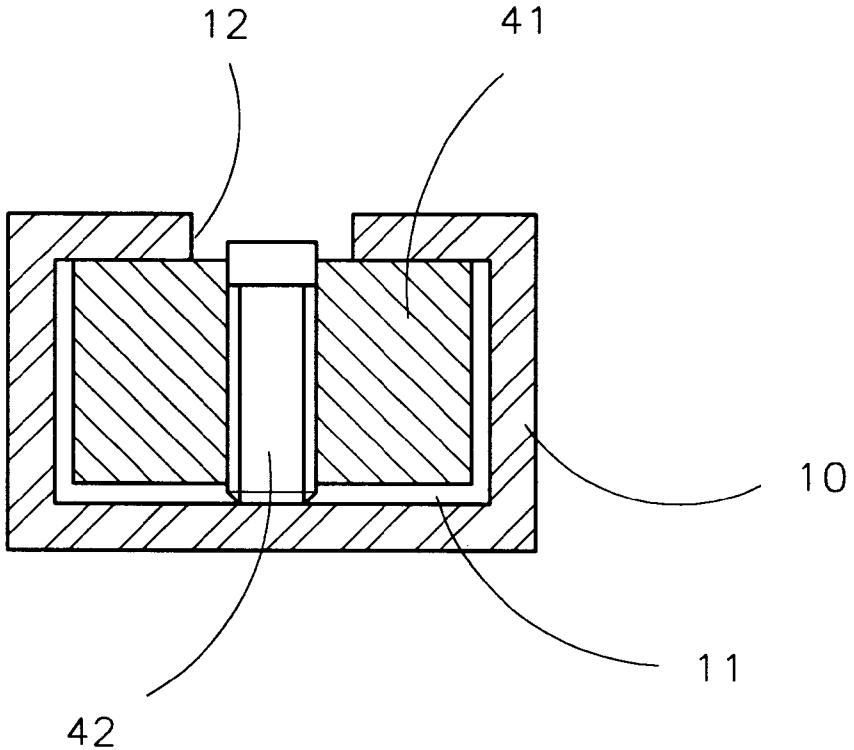
FIG. 2A is a cross-sectional view of the main body and the gliding block of the present invention.

Referring to FIG. 2, each of the two adjusting mechanisms 40 has a gliding block 41, a fixing screw 42 on the gliding block 41, a guiding rod 43, a blocking element 44, and a spring 45. The gliding block 41 is glidingly movable within the gliding groove 11. As shown in FIG. 2A, the fixing screw 42 enters the gliding block 41 from the opening 12, having a lower end that reaches to a lower side of the gliding block 41 and thus is able to contact the lower side of the gliding groove 11. With the fixing screw 42 screwed in tight, the gliding block 41 is pressed against the upper side of the gliding groove 11 and held there in a fixed position. The guiding rod 43 has an inner end that is fastened on the gliding block 41 and an outer end that reaches through the inserted end of the gliding rod 20.

Various shapes of the main body 10 and the gliding block 41 of the present invention are possible. As shown in FIG. 2B, in a second embodiment the present invention has a main body 10A and a gliding block 41A which have circular cross-sections. A fixing screw 42A enters the gliding block 41A through an opening 42A, having a lower end that reaches to a lower side of the gliding block 41A and thus is able to contact the lower side of a gliding groove 11A.

In the above embodiments, the present invention has two gliding rods 20 and two adjusting mechanisms 40. Alternatively, a single gliding rod 20 and a single adjusting mechanisms are employable, as well. With this arrangement, the function is the same as in the first and second embodiments of the present invention, just expansion and compression are restricted to a smaller range.

Referring to FIG. 2, for each of the gliding rods 20, the guiding rod 43 passes through a hole 21 in the inserted end. The hole 43 has a diameter that is larger than the diameter of the guiding rod 43. A blocking element 44 is attached to the outer end of the guiding rod 43, having a diameter that is smaller than the diameter of the hole 21. Thus the guiding rod 43 and the gliding rod are prevented from separating.

Furthermore, for each of the gliding rods 20, a spring 45 is put on the guiding rod 43, inserted between the gliding rod

20 and the gliding block 41. The spring 45 pushes the guiding rod 43 outward.

Figure 3:
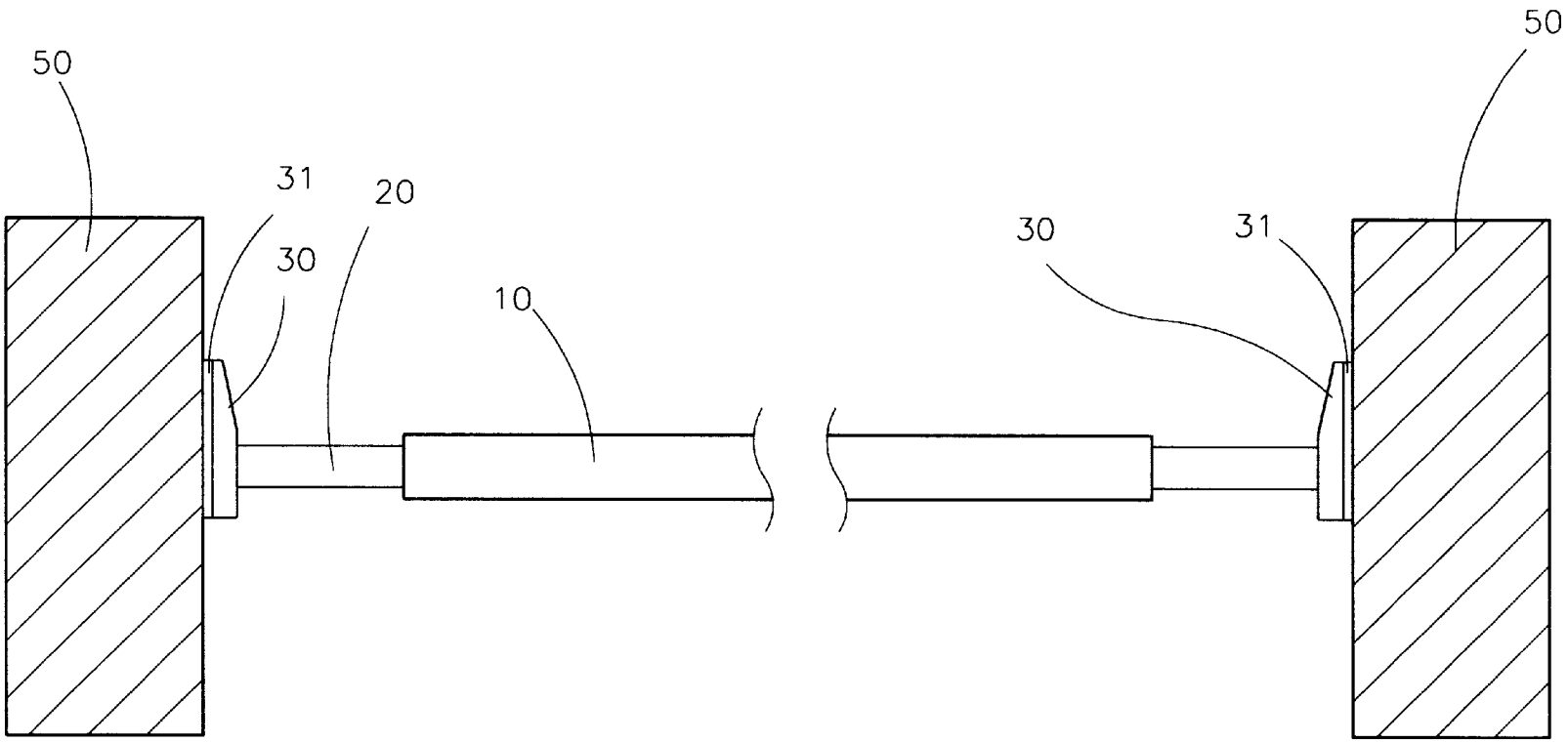
FIG. 3 is a schematic illustration of the adjustable hanging rod of the present invention held between two walls.

Referring to FIG. 3, when the adjustable hanging rod of the present invention is inserted between the two walls 50, the two gliding rods 20 are restricted by the walls 50 and thus kept inside the gliding groove 11 of the main body 10. At the same time, for each of the gliding rods 20, the spring 45 is compressed, developing an outward directed counterforce. Therefore, the two gliding rods are pressed against the walls 50.

Figure 4A:
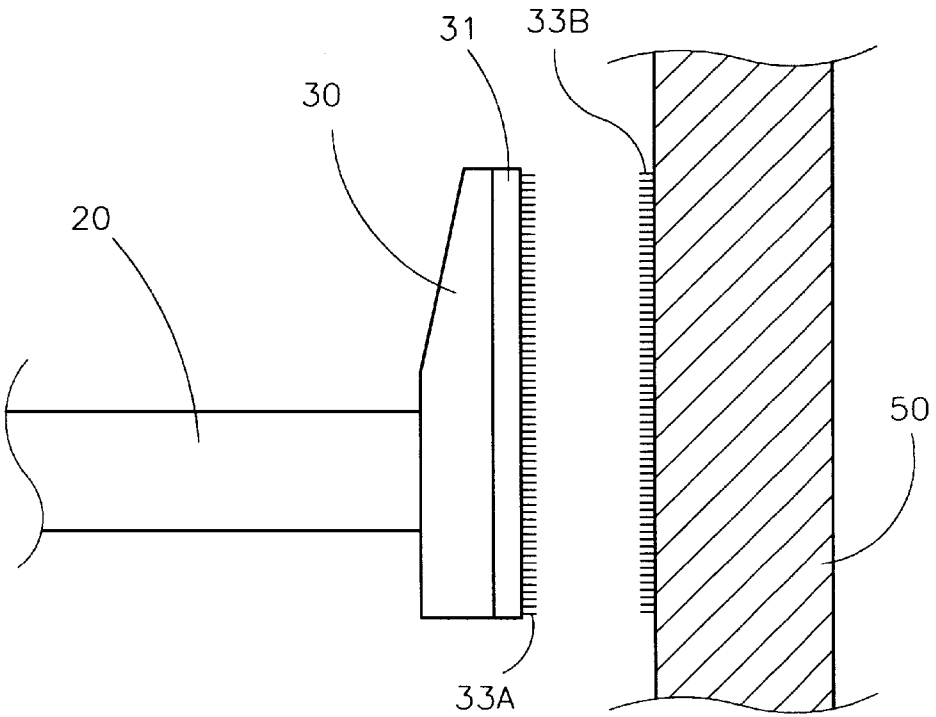
FIG. 4A is a side view of the cap of the present invention in the fourth embodiment.
Figure 4:
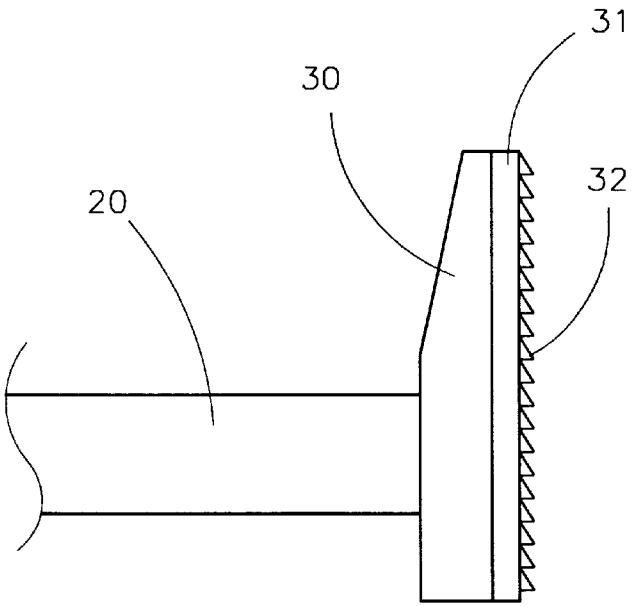
FIG. 4 is a side view of the cap of the present invention in the third embodiment.
Figure 5:
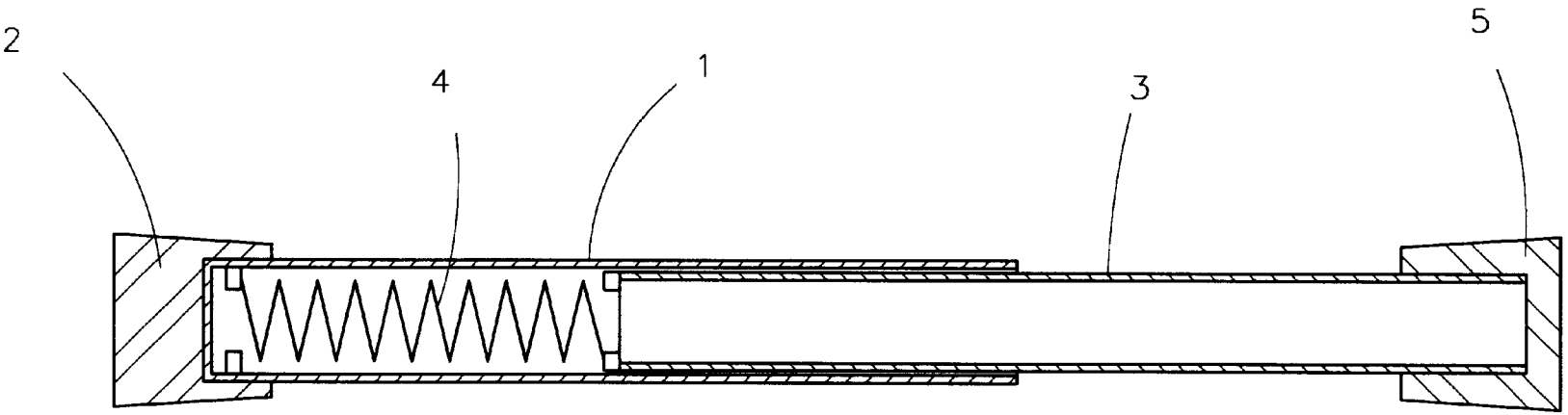
PRIOR ART FIG. 5
FIG. 5 is a sectional view of a conventional hanging rod when assembled.

Referring again to FIG. 2, each of the two contact elements 30 has a contact surface next to one of the walls 50 which is covered by contact material 31. The contact material 31 is material of high friction against the walls 50, such as cork or silicon. As shown in FIG. 4, in a third embodiment of the present invention, the contact surfaces have teeth for a better hold on the walls 50. Alternatively, as shown in FIG. 4, in a fourth embodiment of the present invention, bur-like latches 33A, 33B are laid on the contact surfaces and the walls 50, respectively.

For mounting the present invention between the two walls 50, the gliding blocks 41 are fixed at suitable positions in a way that the contact surfaces of the two contact elements 30 are slightly farther apart than the distance of the two walls 50. Then the two gliding rods 20 are pushed inside, the two contact elements 30 at the far ends of the two gliding rods 20 are positioned on the walls 50, as desired, and the two gliding rods 20 are loosened again. Then the springs 45 push out the two gliding rods 20, so that the two contact elements 30 are held on the two walls 50.

The adjusting mechanisms 40 of the present invention allow to adjust the positions of the gliding blocks 41 for varying how far the two gliding rods 20 extend outward. Thus the present invention is suitable for various distances between the two walls 50, resulting in greater flexibility of application.

While the invention has been described with reference to preferred embodiments thereof, it is to be understood that modifications or variations may be easily made without departing from the spirit of this invention which is defined by the appended claims.

What is claimed is:

1. An adjustable hanging rod, comprising:

a main body with a central gliding groove, at least one gliding rod, an interior end of each said gliding rod being received in an end of said gliding groove, and a contact element corresponding to each of said gliding rods, each said contact element being attached to a distal end of said corresponding gliding rod, said contact element being adapted to contact a wall; wherein at least one adjusting mechanism is mounted inside said main body and is movably connected to said interior end of said gliding rod, said adjusting mechanism comprising a gliding block inserted in said gliding groove, an adjusting rod having a first end attached to said gliding block and a second end received in said interior end of said gliding rod, a spring mounted on said adjustment rod between said gliding block and said interior end of said gliding rod, and a fixing screw passing through said gliding block and contacting a surface of said gliding groove, so that said gliding block is fixed in a locked position by said fixing screw, said locked position being adjustable so that adjusting said locked position changes an effective overall unbiased length of said hanging rod by changing a length of outward extension of said distal end of said gliding rod; such that said spring biases said gliding rod outward so that said contact element is pressed against the wall, and said position of said gliding block is adjustable, so that adjusting said length of outward extension of said gliding rod ensures that pressure of said contact element against the wall is always maintained at a constant level, said overall unbiased length of said hanging rod varying with said adjustable length of outward extension of said gliding rod.

2. An adjustable hanging rod according to claim 1, wherein:

said hanging rod comprises a pair of said adjusting mechanisms, said adjusting mechanisms being mounted symmetrically on ends of said main body.

3. An adjustable hanging rod according to claim 1, wherein:

said main body has an opening to provide access to said fixing screw.

4. An adjustable hanging rod according to claim 1, wherein:

at least one of said main body and said gliding block have a circular cross section.

5. An adjustable hanging rod according to claim 1, wherein:

said contact element has an outer surface covered by a high friction material.

6. An adjustable hanging rod according to claim 1, wherein:

said contact element has a toothed outer surface.

7. An adjustable hanging rod according to claim 1, wherein:

said contact element is connected to the wall with a hook and loop fastener.

* * * * *